United States Patent [19]

Kaczmarek

[11] 4,120,068

[45] Oct. 17, 1978

[54] RALLY WHEEL CLEANING IMPLEMENT

[76] Inventor: Philip Michael Kaczmarek, 11313 Grandville, Detroit, Mich. 48228

[21] Appl. No.: 788,629

[22] Filed: Apr. 18, 1977

[51] Int. Cl.[2] ..... A46B 5/00; A46B 9/00; A46B 15/00

[52] U.S. Cl. ..... 15/160; 15/145; 15/164

[58] Field of Search ..... 15/160, 159 R, 104.03, 15/104.04, 104.05, 143 R, 145, 164, 210

[56] References Cited

U.S. PATENT DOCUMENTS

| | | | |
|---|---|---|---|
| 275,827 | 4/1883 | Illingworth | 15/160 |
| 2,629,121 | 2/1953 | Petre | 15/104.03 |
| 3,034,168 | 5/1962 | Walker | 15/164 X |
| 3,862,461 | 1/1975 | Bucklitzsch | 15/164 |

*Primary Examiner*—Stanley N. Gilreath
*Attorney, Agent, or Firm*—Poms, Smith, Lande & Glenny

[57] ABSTRACT

A cleaning implement including a cylindrical member having brush bristles on its exterior and interior surfaces and bristles on the front and rear edge surface of the cylinder. A handle element is reversibly connected to a threaded bore in a centrally located disc fixed to the interior of the cylinder. The interior bristles are used to clean lug nuts on a rally wheel and the bristles extending from the front and rear edge surfaces are used to clean the edges of the openings through which the lugs extend. The exterior bristles can be used to clean larger openings in the rally wheel, all without removing the rally wheel from a motor vehicle.

3 Claims, 2 Drawing Figures

RALLY WHEEL CLEANING IMPLEMENT

PRIOR ART

The following patents are considered representative of the prior art:

U.S. Pat. No. 832,498
U.S. Pat. No. 605,552
U.S. Pat. No. 1,451,400
U.S. Pat. No. 3,034,168
U.S. Pat. No. 3,355,759
U.S. Pat. No. 3,451,723
U.S. Pat. No. 3,599,263
U.S. Pat. No. 3,843,990
U.S. Pat. No. 3,862,461.

BACKGROUND OF THE INVENTION

This invention relates to a cleaning implement, and more particularly, a brush for use in cleaning rally wheels mounted on motor vehicles.

With the growing popularity of rally wheels there is a growing frustration because of attempts to clean hard-to-reach cracks and crevices provided in such wheels. This has resulted in the necessity to completely remove the wheels, cleaning each nut that mounts the wheels separately as well as the openings receiving lugs and the irregular shaped openings provided in such wheels. This is impractical and if done, is a time-consuming and laborious process. Accordingly, this invention provides a cleaning implement for use in cleaning rally wheels without the necessity of having to remove the wheel from the vehicle.

SUMMARY OF THE INVENTION

In accordance with the invention, the cleaning implement includes a hollow cylindrical flexible member mounting a plurality of bristles on its exterior surface as well as its interior surface and further including bristles extending from the front and rear edge surfaces of the cylindrical member. A T-shaped handle is connected to a supporting disc having a centrally threaded opening within the interior of the cylinder so that the brush is reversible. The interior bristles may be inserted over the lug on a rally wheel and then turned to clean the lug. The bristles extending from the front edge surface of the cylinder will enter the space between the lug and the lug hole behind the nut to clean these surfaces. The exterior bristles may be used to clean edges of openings in the wheel by inserting the exterior surface in such an opening and manipulating the turning the brush. When the front portion of the brush becomes filled with grime and grease, the handle may be reversed presenting a fresh surface for cleaning.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
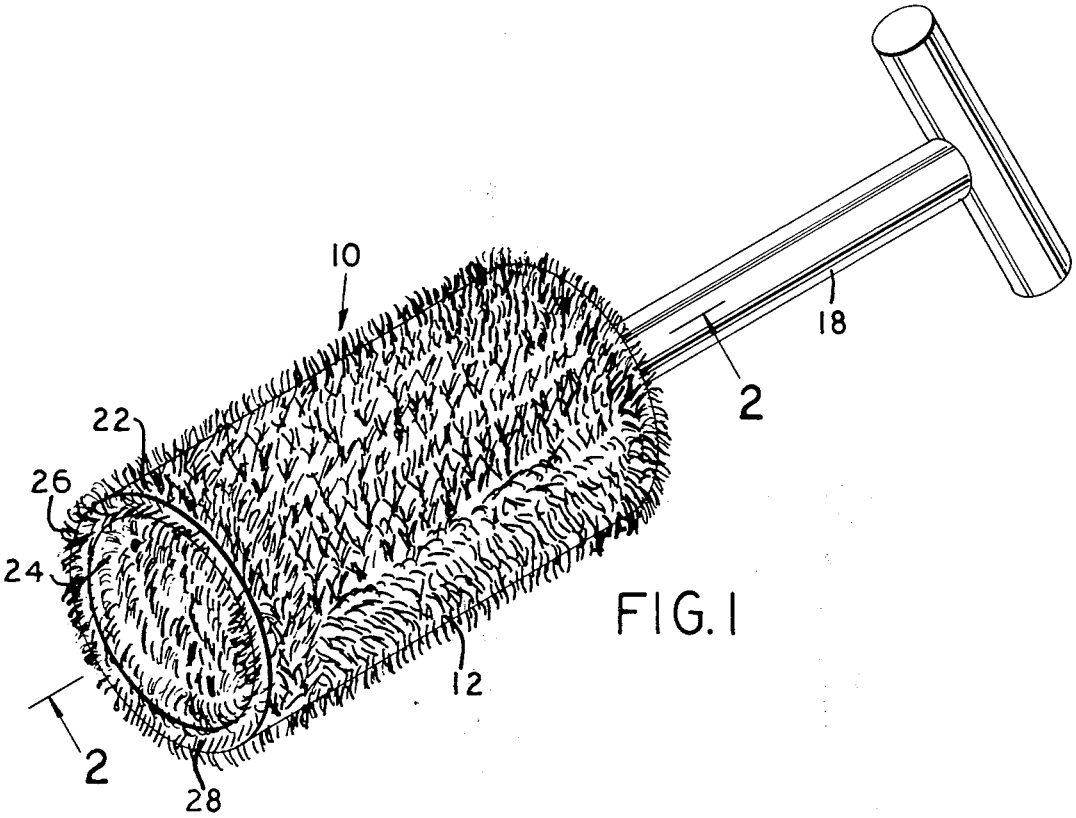
FIG. 1 is a perspective view of the cleaning implement of the present invention.
Figure 2:
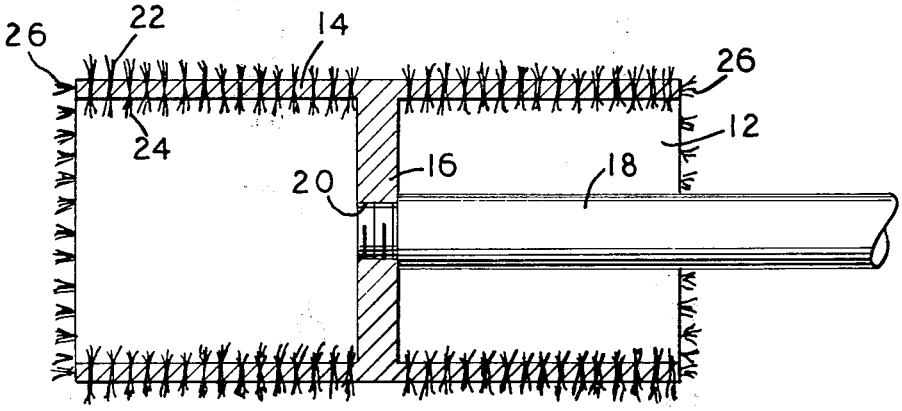
FIG. 2 is a cross-sectional view taken substantially along the plane indicated by line 2—2 of FIG. 1.

Referring now to the drawing in detail, wherein like numerals indicate like elements throughout the several views, the cleaning implement 10 of the present invention includes a hollow cylindrical member 12 having a thin wall 14 and a centrally located disc 16 within the interior thereof.

An elongated T-shaped handle 18 is threadedly connected to a threaded bore 20 in central disc 16. a plurality of brush bristles 22 extend from the exterior surface of cylinder 12, a plurality of bristles extend from the interior surface of cylinder 12, and a plurality of bristles 26 extend outwardly from the front and rear edge surfaces 28 of cylinder 12.

In use, the inner diameter of cylinder 12 is selected to closely approximate lug nuts on a rally wheel. Cylinder 12 is inserted over a lug nut and rotated with bristles 24 cleaning the nut. Bristles 26 extending from front edge surface 28 will seek and enter into the tight crevices behind the lug nut in the hole mounting a lug through the rally wheel. Where the rally wheel has irregular shaped openings, the exterior bristles 22 on the cylinder 12 can be used to clean the interior edges of such openings. Handle 18 may be removed and inserted through the opposite end of cylinder 12 into threaded bore 20 to use the rear half of cylinder 12 as a cleaning implement, as required.

While a specific embodiment of a rally wheel cleaning implement has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A cleaning brush for cleaning recessed lug nuts on the wheel of a vehicle comprising:

a generally thin-walled hollow cylinder having front and rear edge surfaces, an outer surface and an inner surface;

a partition wall extending generally normal to the central longitudinal axis of said cylinder;

a elongated handle fixed to said partition wall having a first end extending in a direction generally coincident with the longitudinal axis of said cylinder and a head fixedly connected to said first end;

a plurality of brush bustles extending outwardly from said outer surface along substantially the entire surface thereof in a direction generally normal to the longitudinal axis of said cylinder;

a plurality of brush bristles extending inwardly from said inner surface toward the central longitudinal axis of said cylinder along substantially the entire surface thereof in a direction generally normal to the longitudinal axis of said cylinder; and a plurality of brush bristles extending from both of said edge surfaces and outwardly therefrom in a direction generally parallel to the central longitudinal axis of said cylinder.

2. In the brush of claim 1 wherein said head extends generally normal to said first end.

3. In the brush of claim 1 including a threaded aperture generally centrally located in said partition wall and extending therethrough and having a longitudinal axis generally coincident with the longitudinal axis of said cylinder, said first end being removably and threaded mounted in said aperture.

* * * * *